US009097258B2

(12) United States Patent
Hofer et al.

(10) Patent No.: US 9,097,258 B2
(45) Date of Patent: Aug. 4, 2015

(54) SUPERSONIC COMPRESSOR COMPRISING RADIAL FLOW PATH

(75) Inventors: Douglas Carl Hofer, Clifton Park, NY (US); Zachary William Nagel, Ballston Lake, NY (US); David Graham Holmes, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 1061 days.

(21) Appl. No.: 12/491,602

(22) Filed: Jun. 25, 2009

(65) Prior Publication Data

US 2010/0329856 A1 Dec. 30, 2010

(51) Int. Cl.

| | |
|---|---|
| ***F04D 21/00*** | (2006.01) |
| ***F04D 17/12*** | (2006.01) |
| ***F04D 29/44*** | (2006.01) |
| *F04D 29/28* | (2006.01) |

(52) U.S. Cl.

CPC ..... *F04D 21/00* (2013.01); *F04D 17/127* (2013.01); *F04D 29/284* (2013.01); *F04D 29/44* (2013.01)

(58) Field of Classification Search

USPC ..... 415/60, 64, 68, 69, 85, 181, 206, 179; 416/126, 128, 175, 185

See application file for complete search history.

(56) References Cited

U.S. PATENT DOCUMENTS

| | | | | |
|---|---|---|---|---|
| 2,318,990 | A * | 5/1943 | Doran | 415/64 |
| 2,344,366 | A * | 3/1944 | Price | 415/64 |
| 2,853,227 | A * | 9/1958 | Beardsley | 415/64 |
| 3,101,170 | A * | 8/1963 | Pavlecka | 415/64 |
| 4,938,661 | A * | 7/1990 | Kobayashi et al. | 415/199.1 |
| 7,293,955 | B2 | 11/2007 | Lawlor et al. | |
| 7,334,990 | B2 | 2/2008 | Lawlor et al. | |
| 7,434,400 | B2 * | 10/2008 | Lawlor et al. | 60/726 |
| 2007/0125346 | A1 * | 6/2007 | Vetrovec | 123/563 |

FOREIGN PATENT DOCUMENTS

| | | |
|---|---|---|
| JP | 4962206 U | 5/1974 |
| JP | 2000154796 A | 6/2000 |

OTHER PUBLICATIONS

Co-pending US Patent Application entitled Supersonic Compressor, U.S. Appl. No. 12/342,278, filed Dec. 23, 2008.

Unofficial English translation of Japanese Office Action issued in connection with corresponding JP Application No. 2010-142122 on Mar. 18, 2014.

* cited by examiner

*Primary Examiner* — Edward Look
*Assistant Examiner* — Jason Davis
(74) *Attorney, Agent, or Firm* — Andrew J. Caruso

(57) ABSTRACT

The present invention provides novel supersonic compressors comprising novel supersonic compressor rotors. The supersonic compressor rotors are designed to operate at very high rotational speed wherein the velocity of the gas entering the supersonic compressor rotor is greater than the local speed of sound in the gas, hence the descriptor "supersonic". The new supersonic compressors comprise at least one supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp. The novel supersonic compressor rotors are expected to enhance the performance of supersonic compressors comprising them, and to provide for greater design versatility in systems comprising such novel supersonic compressors.

18 Claims, 9 Drawing Sheets

SUPERSONIC COMPRESSOR COMPRISING RADIAL FLOW PATH

BACKGROUND

The present invention relates to compressors and systems comprising compressors. In particular, the present invention relates to supersonic compressors comprising supersonic compressor rotors and systems comprising the same.

Conventional compressor systems are widely used to compress gases and find application in many commonly employed technologies ranging from refrigeration units to jet engines. The basic purpose of a compressor is to transport and compress a gas. To do so, a compressor typically applies mechanical energy to a gas in a low pressure environment and transports the gas to and compresses the gas within a high pressure environment from which the compressed gas can be used to perform work or as the input to a downstream process making use of the high pressure gas. Gas compression technologies are well established and vary from centrifugal machines to mixed flow machines, to axial flow machines. Conventional compressor systems, while exceedingly useful, are limited in that the pressure ratio achievable by a single stage of a compressor is relatively low. Where a high overall pressure ratio is required, conventional compressor systems comprising multiple compression stages may be employed. However, conventional compressor systems comprising multiple compression stages tend to be large, complex and high cost.

More recently, compressor systems comprising a supersonic compressor rotor have been disclosed. Such compressor systems, sometimes referred to as supersonic compressors, transport and compress gases by contacting an inlet gas with a moving rotor having rotor rim surface structures which transport and compress the inlet gas from a low pressure side of the supersonic compressor rotor to a high pressure side of the supersonic compressor rotor. While higher single stage pressure ratios can be achieved with a supersonic compressor as compared to a conventional compressor, further improvements would be highly desirable.

As detailed herein, the present invention provides novel supersonic compressors which provide enhancements in compressor performance relative to known supersonic compressors.

BRIEF DESCRIPTION

In one embodiment, the present invention provides a supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp.

In another embodiment, the present invention provides a supersonic compressor comprising (a) a fluid inlet, (b) a fluid outlet, and (c) at least one supersonic compressor rotor, said supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp.

In yet another embodiment, the present invention provides a supersonic compressor comprising (a) a gas conduit comprising (i) a low pressure gas inlet, and (ii) a high pressure gas outlet; (b) a first supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp; (c) a second supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp; and (d) a conventional centrifugal compressor rotor; said conventional centrifugal compressor rotor being disposed within the inner cylindrical cavity of the first supersonic compressor rotor, said first supersonic compressor rotor being disposed within the inner cylindrical cavity of the second supersonic compressor rotor, said conventional centrifugal compressor rotor being configured to counter-rotate with respect to said first supersonic compressor rotor, said first supersonic compressor rotor being configured to counter-rotate with respect to said second supersonic compressor rotor, said conventional centrifugal compressor rotor and said first supersonic compressor rotor and said second supersonic compressor rotor being disposed within the gas conduit.

In yet another embodiment, the present invention provides a method of compressing a fluid, said method comprising (a) introducing a fluid through a low pressure gas inlet into a gas conduit comprised within a supersonic compressor; and (b) removing a gas through a high pressure gas outlet of said supersonic compressor; said supersonic compressor comprising a supersonic compressor rotor disposed between said gas inlet and said gas outlet, said supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp.

BRIEF DESCRIPTION OF THE DRAWING FIGURES

In order that those of ordinary skill in the art may fully understand the novel features, principles and advantages of present invention, this disclosure provides, in addition to the detailed description, the following figures.

Figure 1:
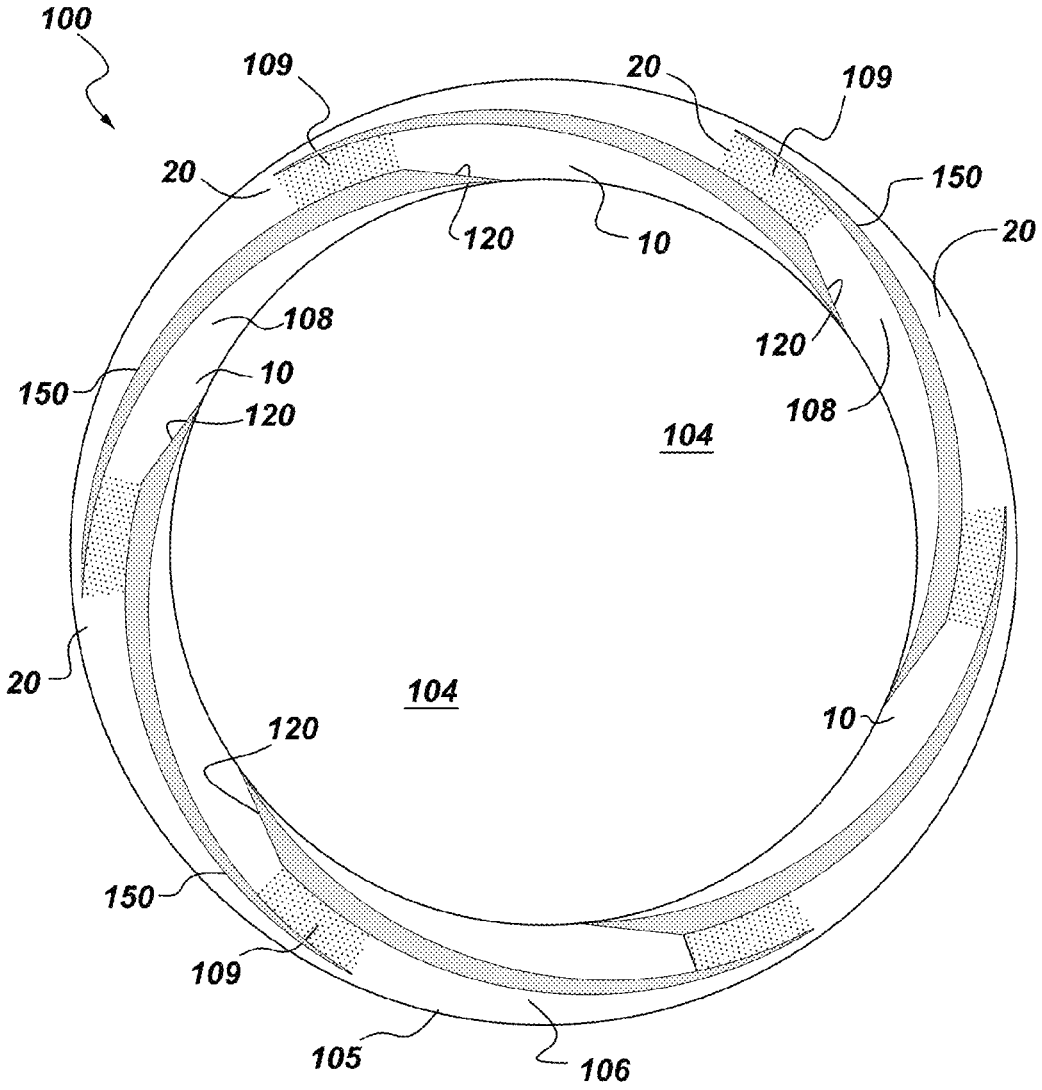
FIG. 1 represents a portion of a supersonic compressor rotor provided by the present invention.

Various features, aspects, and advantages of the present invention will become better understood when the following detailed description is read with reference to the accompanying drawings in which like characters represent like parts throughout the drawings. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor" refers to a compressor comprising a supersonic compressor rotor.

Known supersonic compressors, which may comprise one or more supersonic compressor rotors, are configured to compress a fluid between the outer rim of the supersonic compressor rotor and the inner wall of the fluid conduit in which the supersonic compressor rotor is disposed. In such supersonic compressors, fluid is transported across the outer rotor rim of the supersonic compressor rotor from the low pressure side of the fluid conduit to the high pressure side of the fluid conduit. Strakes arrayed on the outer rotor rim provide a flow channel through which fluid moves from one side of the supersonic compressor rotor to the other. Supersonic compressors comprising supersonic compressor rotors are described in detail in, for example, U.S. Pat. Nos. 7,334,990 and 7,293,955 filed Mar. 28, 2005 and Mar. 23, 2005 respectively.

The present invention features novel supersonic compressor rotors in which fluid transport from the low pressure side of the fluid conduit to the high pressure side of the fluid conduit occurs via a radial flow channel linking an inner cylindrical cavity of the supersonic compressor rotor to the outer rotor rim. The novel design features of the supersonic compressor rotors provided by the present invention are expected to enhance performance of supersonic compressors comprising them, and to provide for greater design versatility in systems comprising such novel supersonic compressors. The novel supersonic compressor rotors provided by the present invention can be configured for inside-out compression or outside-in compression. The supersonic compressor rotor is configured for inside-out compression when during operation as the rotor spins gas moves from the inner cylindrical cavity through the radial flow channel to the outer rotor rim. The supersonic compressor rotor is configured for outside-in compression when during operation as the rotor spins gas moves from the outer rotor rim through the radial flow channel to the inner cylindrical cavity. Whether or not a supersonic compressor rotor is configured for inside-out or outside compression is determined by the location of the supersonic compression ramp within the radial flow channel and the configuration of the vanes at the fluid inlet of the radial flow channel. In the various examples illustrated in the figures herein, the supersonic compressor rotors are shown as configured for inside-out compression.

FIG. 1 illustrates an embodiment of the present invention which is a supersonic compressor rotor. The view shows key components of a supersonic compressor rotor 100 comprising a first rotor support plate 105 having an inner surface 106 upon which are disposed vanes 150 configured to define a plurality of radial flow channels 108, each radial flow channel having a fluid inlet 10, a fluid outlet 20 and a subsonic diffusion zone 109. In the embodiment shown in FIG. 1, each vane 150 is shown as comprising a supersonic compression ramp 120 which will be discussed in detail hereafter in this disclosure. It is the presence of supersonic compression ramp 120 which qualifies the rotors provided by the present invention as supersonic compressor rotors. A second rotor support plate (not shown) when disposed upon the surface created by vanes 150 completes the basic design of the supersonic compressor rotor illustrated in FIG. 1. The two rotor support plates 105 of the embodiment illustrated in FIG. 1 can be visualized as a pair of washer-shaped plates between which vanes 150 are disposed, the vanes and plates defining one or more radial flow channels 108. The supersonic compressor rotor illustrated in FIG. 1 defines an inner cylindrical cavity 104 which is in fluid communication with the outer rotor rim 112 (not shown) via the radial flow channels 108. The radial flow channel is said to allow fluid communication between the inner cylindrical cavity 104 and the outer rotor rim.

Figure 2:
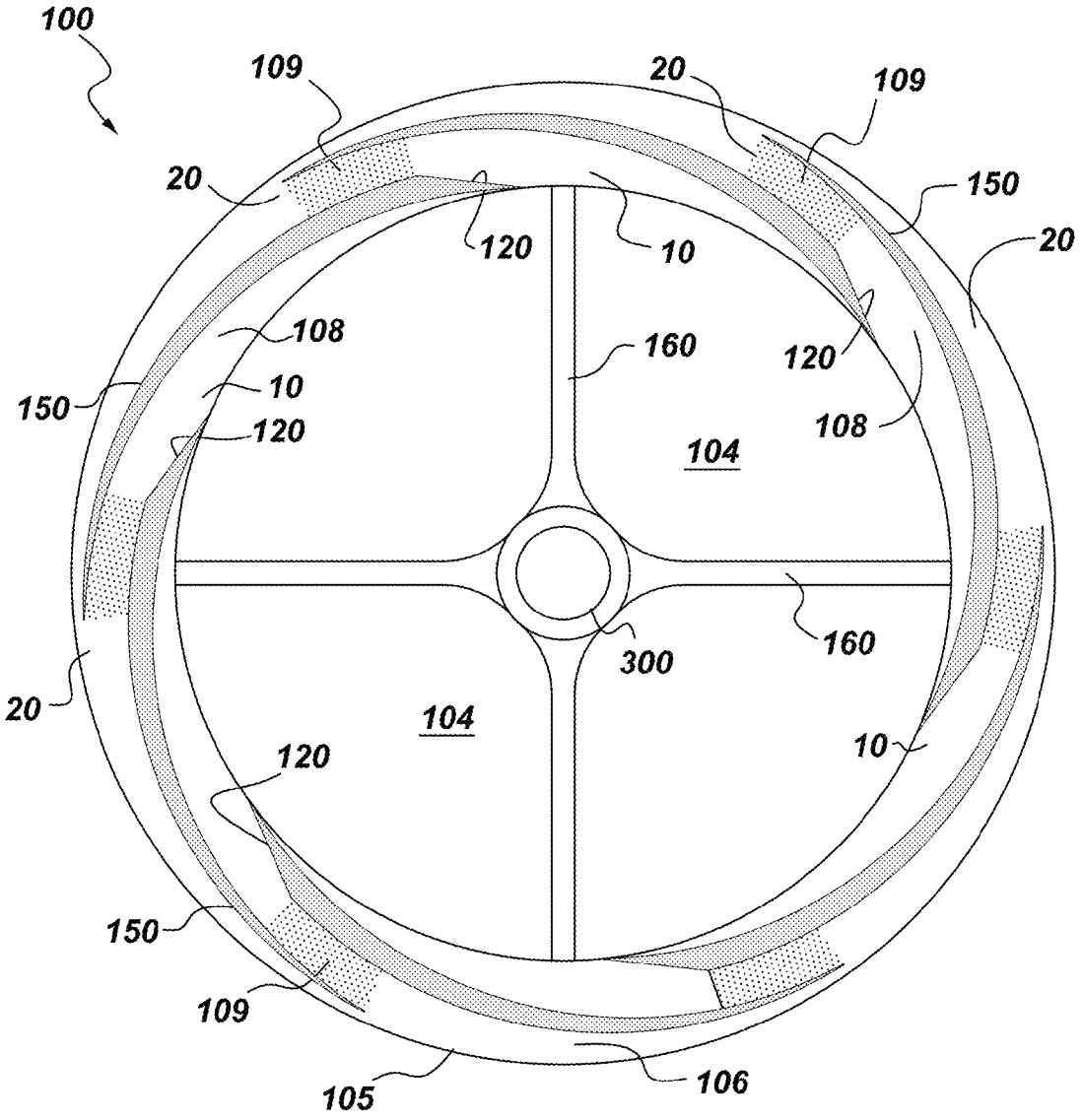
FIG. 2 represents a portion of a supersonic compressor rotor provided by the present invention.

In one embodiment, the supersonic compressor rotor provided by the present invention may be rotated about its axis of rotation by means of a drive shaft coupled to the rotor. FIG. 2 illustrates a supersonic compressor rotor 100 attached via rotor support strut 160 to drive shaft 300. The rotor support strut 160 may be attached to one or both rotor support plates 105.

A supersonic compressor rotor provided by the present invention is said to be "supersonic" because it is designed to rotate about an axis of rotation at high speeds such that a moving fluid, for example a moving gas, encountering the rotating supersonic compressor rotor at a supersonic compression ramp disposed within a radial flow channel of the rotor, is said to have a relative fluid velocity which is supersonic. The relative fluid velocity can be defined in terms of the vector sum of the rotor velocity at the leading edge of a supersonic compression ramp and the fluid velocity just prior to encountering the leading edge of such supersonic compression ramp. This relative fluid velocity is at times referred to as the "local supersonic inlet velocity", which in certain embodiments is a combination of an inlet gas velocity and a tangential speed of a supersonic compression ramp disposed within a radial flow channel of the supersonic compressor rotor. The supersonic compressor rotors are engineered for service at very high tangential speeds, for example tangential speeds in a range of 300 meters/second to 800 meters/second.

Figure 3:
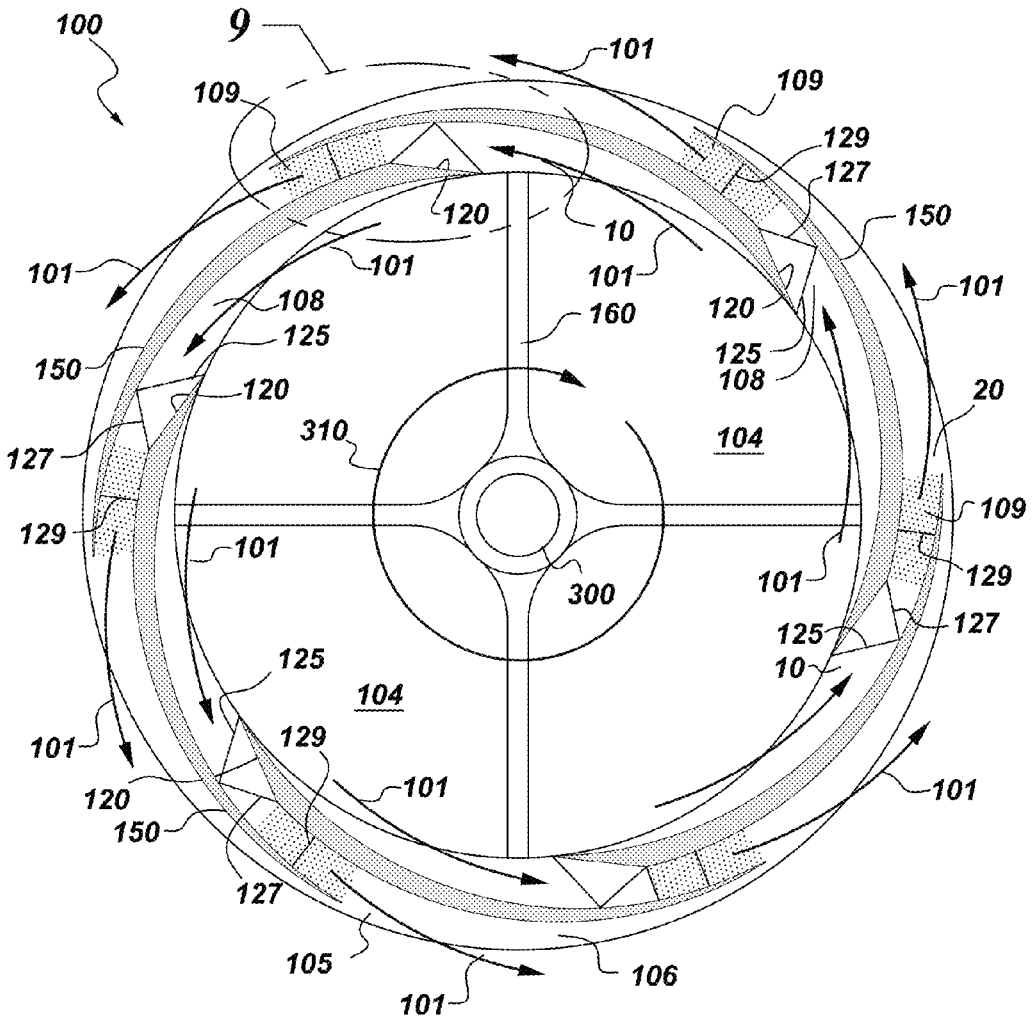
FIG. 3 represents a portion of a supersonic compressor rotor provided by the present invention.
Figure 9:
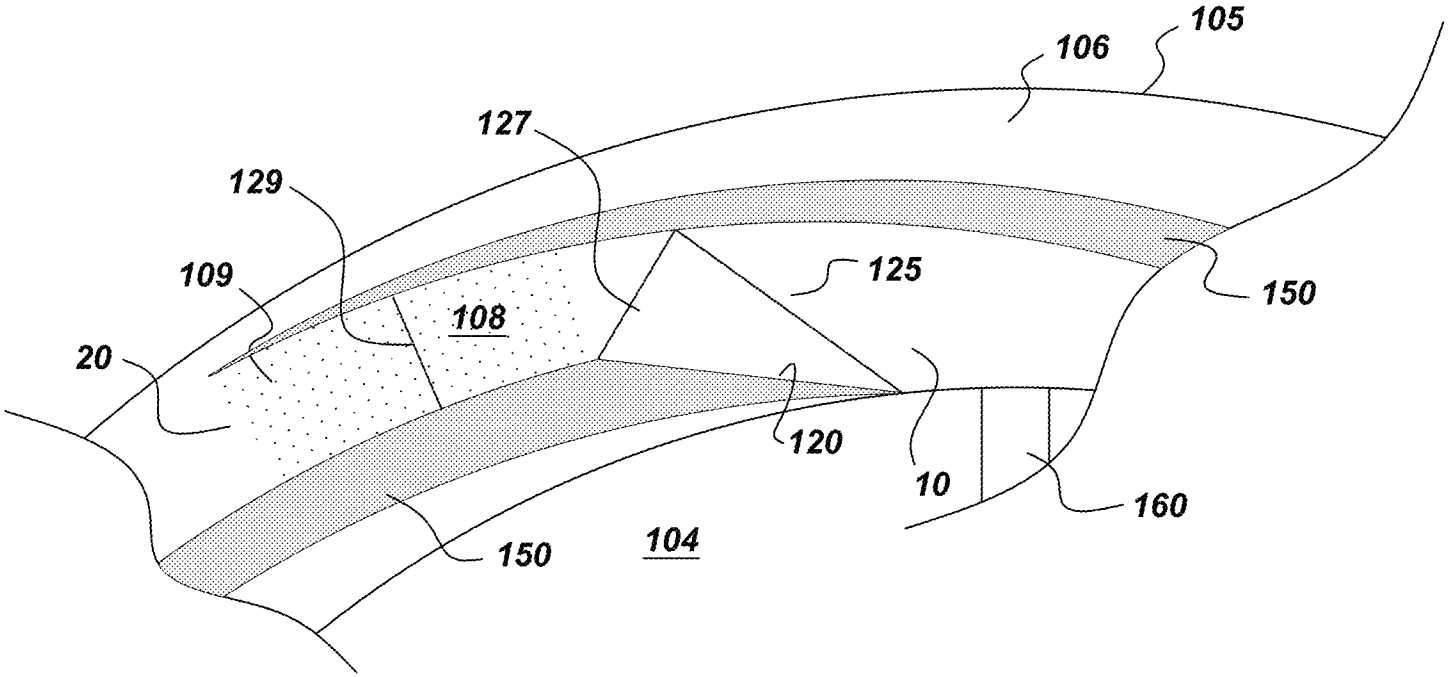
FIG. 9 represents a portion of a supersonic compressor rotor provided by the present invention.

FIG. 3 illustrates a supersonic compressor rotor 100 in motion around an axis of rotation defined by drive shaft 300. In the embodiment illustrated in FIG. 3, as supersonic compressor rotor 100 is rotated in direction 310 fluid within inner cylindrical cavity 104 enters radial flow channel 108 via fluid inlet 10 and exits radial flow channel 108 via fluid outlet 20. Directional arrows 101 indicate the direction of fluid flow through radial flow channel 108 from inner cylindrical cavity 104 to the outer rotor rim (not shown). At very high tangential speeds, an oblique shock wave 125 may be set up within the radial flow channel 108. FIG. 9 further illustrates fluid behavior within a rotating supersonic compressor rotor of the invention. In FIG. 9 an oblique shock wave 125 is generated at the leading edge of supersonic compression ramp 120 and is reflected by the adjacent vane 150 creating reflected shock wave 127. Downstream of the supersonic compression ramp, the channel area increases in the direction of flow and a normal shock wave 129 is set up in this channel followed by a subsonic diffusion zone 109.

Figure 4:
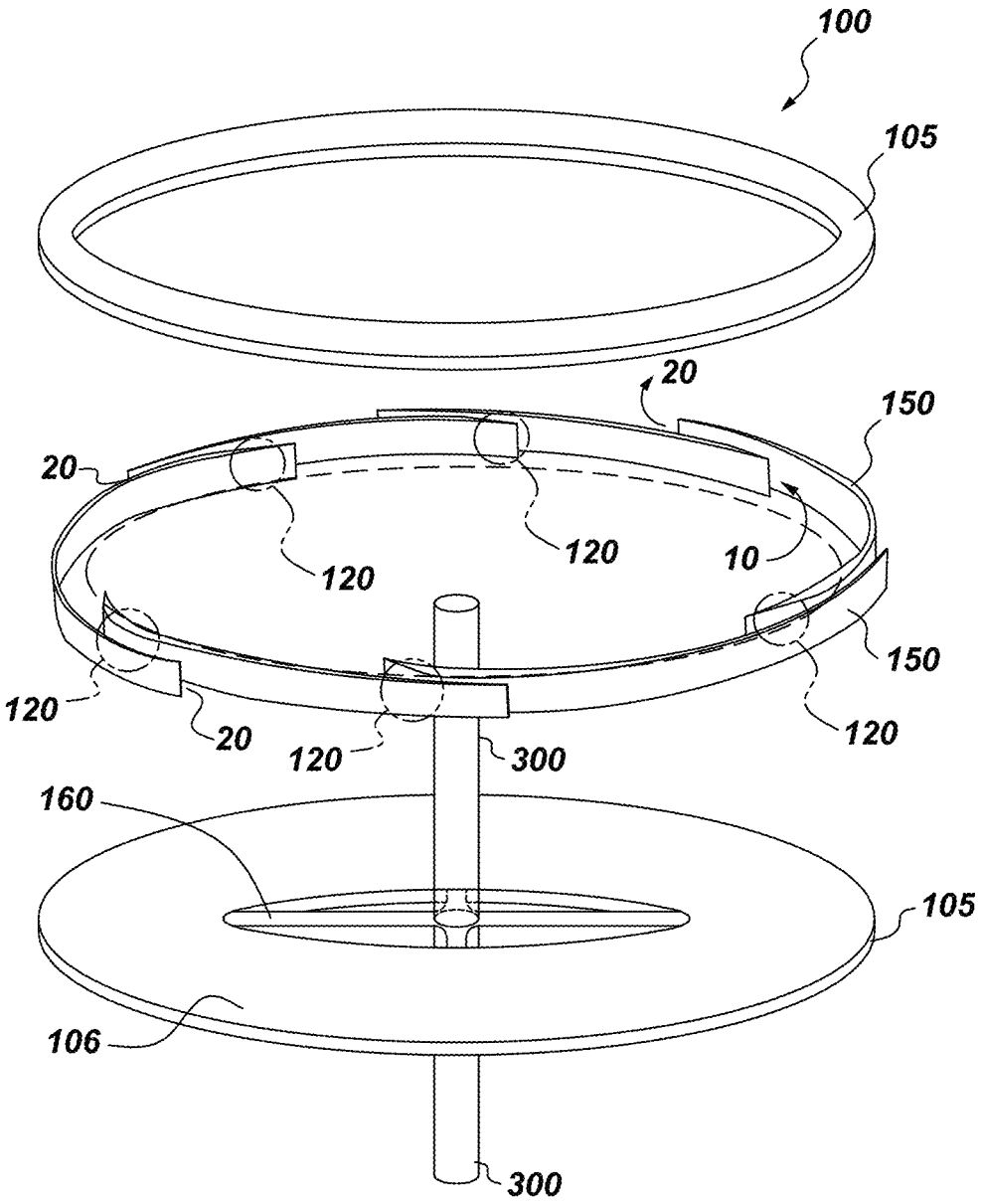
FIG. 4 represents components of a supersonic compressor rotor provided by the present invention.

FIG. 4 illustrates an embodiment of a supersonic compressor rotor 100 provided by the present invention. The supersonic compressor rotor is shown in an exploded view and shows a first rotor support plate 105 (lower plate) having an inner surface 106 and attached via rotor support struts 160 to drive shaft 300. Vanes 150 may be disposed upon the inner surface 106 of rotor support plate 105. A second rotor support plate 105 (upper plate) in this embodiment having the same radius as the first rotor support plate is disposed over vanes 150. A second set of rotor support struts 160 (not shown) can be used to secure the second rotor support plate to drive shaft 300. The second rotor support plate 105 may be secured to drive shaft 300 in such a manner so as to secure vanes 150 between the two rotor support plates. In one embodiment, the inner surface 106 of one or both of rotor support plates 105 comprises vane-shaped grooves into which the vanes 150 are inserted to further secure the vanes to the rotor support plate. In one embodiment, the vane-shaped grooves are of a uniform depth which corresponds to approximately a tenth of the height of the vane. In one embodiment, the supersonic compressor rotor is machined from a single piece of metal. In an alternate embodiment, the supersonic compressor rotor is prepared by a metal casting technique. In yet another embodiment, the components of the supersonic compressor rotor, for example the rotor support plates and vanes may be brazed, welded, or bolted together. In one embodiment, the first rotor support plate 105 is a washer-shaped structure like those shown in FIG. 4, and the second rotor support plate 105 is a solid disk which does not define an aperture.

In the embodiments shown in FIGS. 1-4, the supersonic compression ramps 120 are shown as being integral to a vane, as in the case wherein the vane is machined from a single piece of metal. In an alternate embodiment, the supersonic compression ramp is not integral to a vane, as in the case wherein the vane and supersonic compression ramp are machined from two different pieces of metal.

In one embodiment, the present invention provides a supersonic compressor comprising a housing having a fluid inlet and a fluid outlet, and a supersonic compressor rotor disposed between the fluid inlet and the fluid outlet. In various embodiments, the supersonic compressor rotor defines an inner cylindrical cavity and an outer rotor rim and at least one radial flow channel allowing fluid communication between the inner cylindrical cavity and the outer rotor rim. The radial flow channel is equipped with a supersonic compression ramp. During operation of the compressor, the radial flow channel compresses and conveys fluid from a low pressure side of the supersonic compressor rotor (the inlet side) to a high pressure side of the supersonic compressor rotor (the outlet side). In one embodiment, a set of vanes together with a pair of rotor support plates define the boundaries of the radial flow channel. The vanes and supersonic compression ramp of the radial flow channel, act in tandem to capture fluid at the inlet of the radial flow channel and to compress the fluid between the surface of the supersonic compression ramp and a surface of an adjacent vane, and to transfer the fluid captured to the outlet of the radial flow channel. The supersonic compressor rotor is designed such that distance between at least one location on the rotor support plates and the inner surface of the compressor housing is minimized thereby limiting return passage of gas from the from the high pressure side (outlet side) of the supersonic compressor rotor to the low pressure side (inlet side) of the supersonic compressor rotor to the inlet surface.

Figure 5:
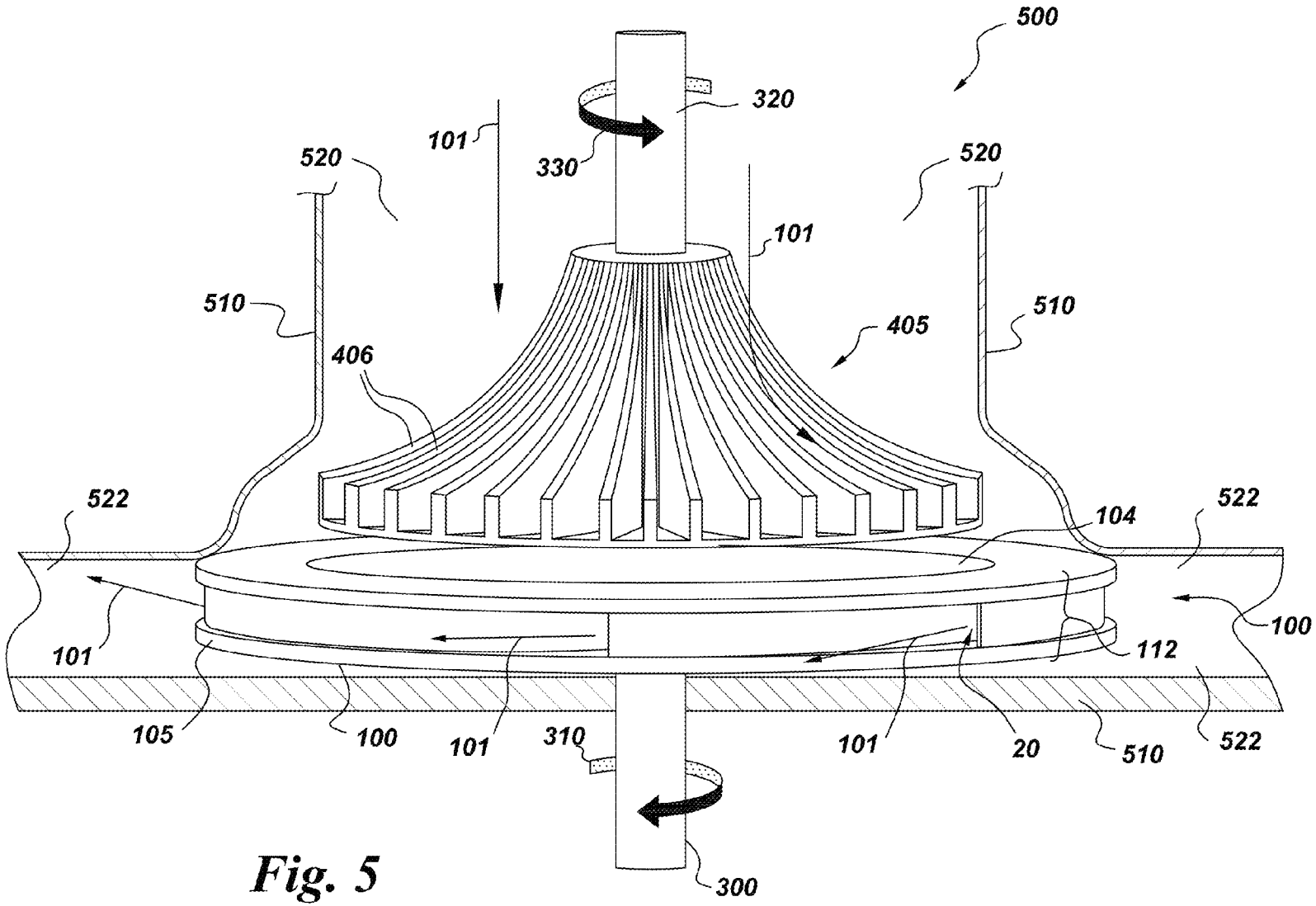
FIG. 5 represents an exploded view of a supersonic compressor provided by the present invention.
Figure 6:
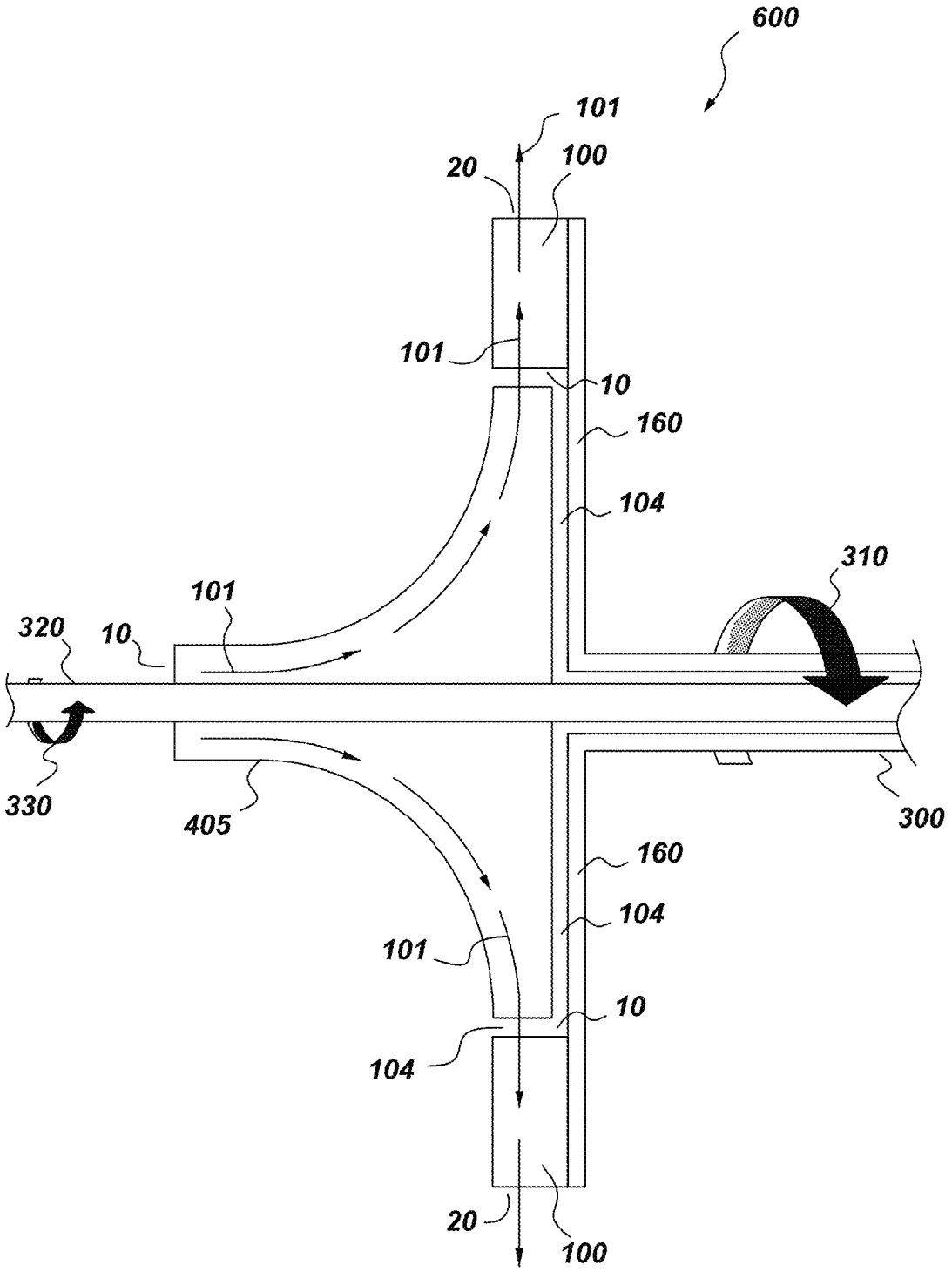
FIG. 6 represents an alternate view of the supersonic compressor shown in FIG. 5.

Referring to FIG. 5, the figure illustrates an embodiment of the present invention and some basic attributes of its operation. The figure illustrates a supersonic compressor 500 shown in an exploded view comprising a supersonic compressor rotor 100 and a conventional centrifugal compressor rotor 405 housed within compressor housing 510. The supersonic compressor rotor 100 and conventional centrifugal compressor rotor 405 are said to be disposed within a fluid conduit of the supersonic compressor, the fluid conduit being defined at least in part by the compressor housing, the fluid conduit comprising a low pressure side 520 and a high pressure side 522, referred to as the low pressure side of the fluid conduit 520 and the high pressure side of the fluid conduit 522, respectively. The view shown in FIG. 5 is "exploded" in the sense that the conventional centrifugal compressor rotor 405 is separated from and above the inner cylindrical cavity 104 of the supersonic compressor rotor 100. As is shown in FIG. 6 of this disclosure, the conventional centrifugal compressor rotor 405 is actually disposed within the inner cylindrical cavity 104 in the embodiment illustrated in FIG. 5. Supersonic compressor rotor 100 is driven by drive shaft 300 in direction 310. The conventional centrifugal compressor rotor 405 is driven by drive shaft 320 in direction 330. As shown the supersonic compressor rotor 100 and conventional centrifugal compressor rotor 405 are configured for counter rotary motion. A fluid (not shown) introduced through a compressor inlet (not shown) enters the low pressure side of the fluid conduit 520 and encounters blades 406 of the conventional centrifugal compressor rotor 405 rotating in direction 330. The direction of fluid flow 101 is changed as the fluid encounters the rotating conventional centrifugal compressor rotor. The fluid is directed radially outward from the conventional centrifugal compressor rotor 405 disposed within inner cylindrical cavity 104 of supersonic compressor rotor 100. Supersonic compressor rotor 100 defines an inner cylindrical cavity 104 and an outer rotor rim 112 and at least one radial flow channel 108 (not shown) allowing fluid communication between the inner cylindrical cavity 104 and the outer rotor rim 112, said radial flow channel comprising a supersonic compression ramp (not shown). The embodiment shown in FIG. 5 comprises a first rotor support plate 105 (upper rotor support plate) and a second rotor support plate 105 (lower rotor support plate). The first rotor support plate defines an aperture through which conventional centrifugal compressor rotor 405 may be inserted into the inner cylindrical cavity 104. The second rotor support plate may or may not comprise an aperture. Thus in one embodiment, the lower rotor support plate 105 is a solid disk. In an alternate embodiment, the lower rotor support plate 105 comprises one or more apertures. In the embodiment shown, the second rotor support plate is mechanically coupled to drive shaft 300. In one embodiment, this mechanical coupling of the lower rotor support plate is effected by means of a rotor support strut 160 (not shown in FIG. 5). The radially outward moving fluid encounters the fluid inlet 10 (not shown) of the rotating supersonic compressor rotor 100 and is directed into a radial flow channel 108 (not shown) which allows the fluid to pass from the inner cylindrical cavity 104 to the outer rotor rim 112 of the supersonic compressor rotor. The radial flow channel 108 comprises a supersonic compression ramp 120 (not shown) which compresses the fluid within the radial flow channel and directs the compressed fluid toward fluid outlet 20. The fluid exiting fluid outlet 20 then enters the high pressure side of the fluid conduit 522. The compressed fluid within the high pressure side of the fluid conduit 522 may be used to perform work.

Referring to FIG. 6, the figure represents a cross section view of a portion 600 of the supersonic compressor 500 illustrated in FIG. 5 and shows conventional centrifugal compressor rotor 405 as disposed within the inner cylindrical cavity 104 of supersonic compressor rotor 100. The conventional centrifugal compressor rotor 405 is driven by drive shaft 320 in direction 330. A portion of drive shaft 320 is shown as being disposed within concentric drive shaft 300 which drives the supersonic compressor rotor 100 in direction 310. Drive shaft 300 is shown as mechanically coupled to supersonic compressor rotor 100 by rotor support struts 160. The direction of fluid flow 101 is indicated through the conventional centrifugal compressor rotor 405 and across the supersonic compressor rotor 100. Fluid enters the supersonic compressor rotor 100 from inner cylindrical cavity 104 at fluid inlet 10 and traverses the supersonic compressor rotor via radial flow channel 108 (not shown) and emerges via fluid outlet 20 at the outer rotor rim 112 (shown in FIG. 5).

As noted, the supersonic compressor featured in FIG. 5 and provided by the present invention comprises two counter rotary rotors, a supersonic compressor rotor 100 comprising a radial flow channel, and a conventional centrifugal compressor rotor 405 arrayed in series such that an output from the upstream conventional centrifugal compressor rotor, for example carbon-dioxide or air, is used as the input for a downstream supersonic compressor rotor of the invention rotating in a sense opposite that of the rotation of the upstream conventional centrifugal compressor rotor. For example, if the downstream supersonic compressor rotor is configured to rotate in a clockwise manner, the upstream conventional centrifugal compressor rotor is configured to rotate in a counter-clockwise manner. The conventional centrifugal compressor rotor and the supersonic compressor rotor are said to be configured to counter-rotate with respect to one another.

Figure 7:
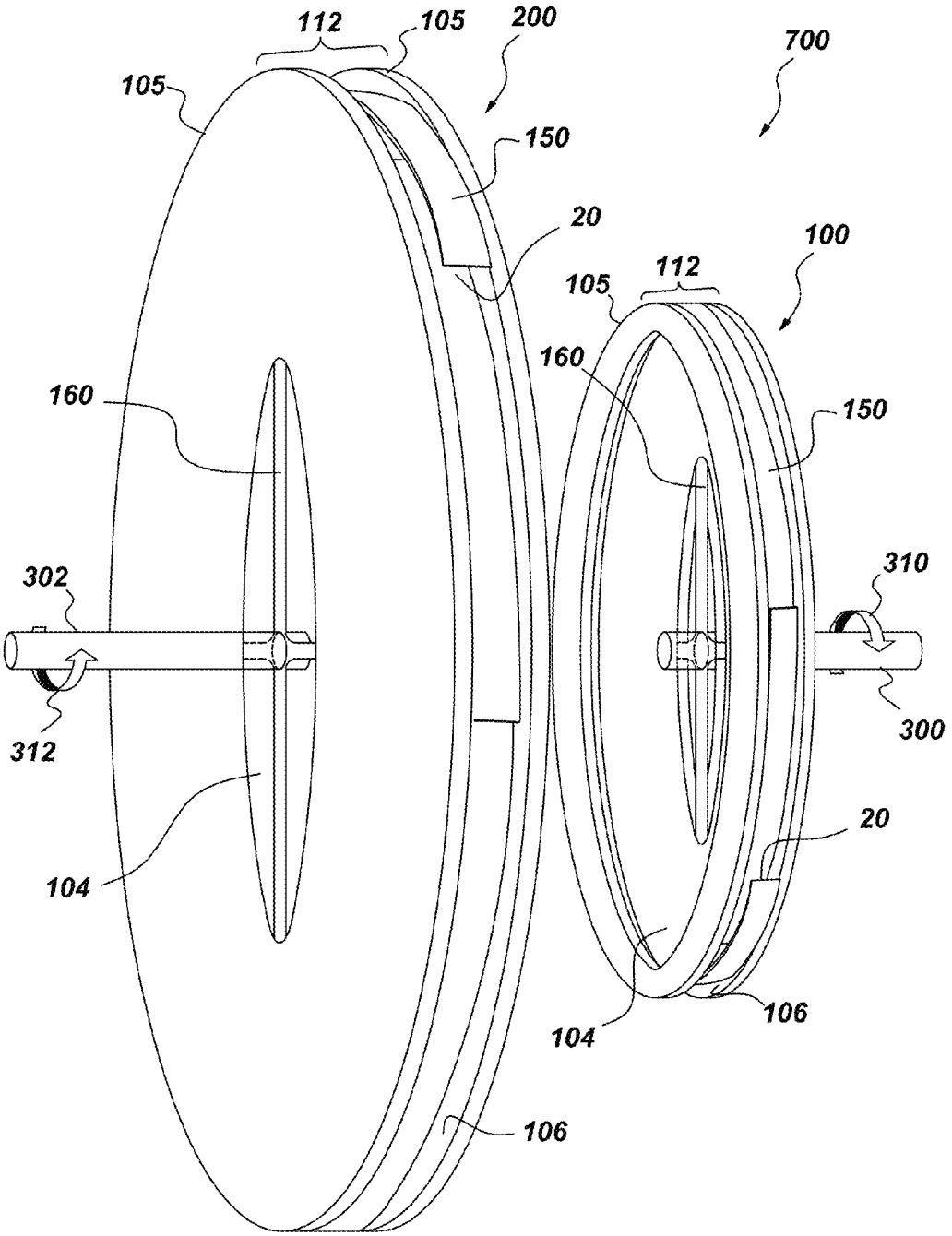
FIG. 7 represents an exploded view of an embodiment of the present invention comprising a pair of concentric supersonic compressor rotors.

In certain embodiments, the present invention provides a supersonic compressor comprising a plurality of supersonic compressor rotors. FIG. 7 illustrates how supersonic compressor rotors can be configured concentrically and in series such that the output of a first supersonic compressor rotor becomes the input for a second supersonic compressor rotor. The configuration 700 shown in FIG. 7 represents an exploded view in the sense that the first supersonic compressor rotor 100 is actually disposed within the inner cylindrical cavity 104 of second supersonic compressor rotor 200. Each of the first supersonic compressor rotor and the second supersonic compressor rotor defines an inner cylindrical cavity 104, an outer rotor rim 112 and at least one radial flow channel 108 (See inter alia FIG. 9) allowing fluid communication between the inner cylindrical cavity and the outer rotor rim, said radial flow channel comprising a supersonic compression ramp 120 (See inter alia FIG. 9). In the embodiment shown in FIG. 7 first supersonic compressor rotor 100 is shown as attached to drive shaft 300 via rotor support struts 160, and second supersonic compressor rotor 200 is shown as attached to drive shaft 302 via rotor support struts 160. The first supersonic compressor rotor 100 and the second supersonic compressor rotor 200 are configured to counter-rotate in direction of rotation 310 and 312 respectively.

In FIG. 7, in each of the depictions of the first supersonic compressor rotor 100 and the second supersonic compressor rotor 200, a portion of at least one vane 150 appears not to be disposed between the rotor support plates 105. This has been done to better emphasize visually the presence of fluid outlet 20 at the outer rotor rim 112, and not to suggest that any portion of the vanes 150 is not disposed within the rotor support plates 105. Thus, in the embodiment shown in FIG. 5, the vanes 150 are fully disposed within rotor support plates 105 and no portion of a vane extends beyond the limit defined by outer rotor rim 112.

In certain embodiments the supersonic compressor rotor provided by the present invention comprises a pair of rotor support plates which are said to be "essentially identical." Rotor support plates are essentially identical when each has the same shape, weight and diameter, is made of the same material, and possesses the same type and number of rim surface features, inner surface of rotor support plate surface features, and outer surface of rotor support plate surface features (collectively surface features).

In an alternate embodiment, the supersonic compressor rotor provided by the present invention comprises a pair of rotor support plates which are not essentially identical, for example as in FIG. 4. As used herein, two rotor support plates are not essentially identical when the rotor support plates are materially different in some aspect. For example, material differences between two rotor support plates include differences in shape, weight and diameter, materials of construction, and type and number of surface features. For example, two otherwise identical rotor support plates comprised of different materials of construction would be said to be "not essentially identical".

In various applications such as fluid compressors, the supersonic compressor rotors of the invention may be driven by means of a drive shaft. In one embodiment, the present invention provides a supersonic compressor comprising a plurality of the supersonic compressor rotors of the invention, each driven by a dedicated drive shaft. In one embodiment, the present invention provides a supersonic compressor comprising a fluid inlet, a fluid outlet, and at least two counter rotary supersonic compressor rotors configured in series such that the fluid output of the first supersonic compressor rotor is the fluid input for the second supersonic compressor rotor wherein the first supersonic compressor rotor is coupled to a first drive shaft, and the second supersonic compressor rotor is coupled to a second drive shaft, wherein the first and second drive shafts are arrayed a long a common axis of rotation. As will be appreciated by those of ordinary skill in the art where two counter-rotary supersonic compressor rotors are driven each by a dedicated drive shaft, the drive shafts will in various embodiments themselves be configured for counter-rotary motion. In one embodiment, the first and second drive shafts are counter-rotary, share a common axis of rotation and are concentric, meaning one of the first and second drive shafts is disposed within the other drive shaft. In one embodiment, the supersonic compressor provided by the present invention comprises first and second drive shafts which are coupled to a common drive motor. In an alternate embodiment, the supersonic compressor provided by the present invention comprises first and second drive shafts which are coupled to at least two different drive motors. Those of ordinary skill in the art will understand that the drive motors are used to "drive" (spin) the drive shafts and these in turn drive the supersonic compressor rotors, and understand as well commonly employed means of coupling drive motors (via gears, chains and the like) to drive shafts, and further understand means for controlling the speed at which the drive shafts are spun. In one embodiment, the first and second drive shafts are driven by a counter-rotary turbine having two sets of blades configured for rotation in opposite directions, the direction of motion of a set of blades being determined by the shape of the constituent blades of each set.

In one embodiment, the present invention provides a supersonic compressor comprising at least two counter-rotary supersonic compressor rotors each comprising at least one radial flow channel. For example, the supersonic compressor rotors may be configured in series such that an output from a first supersonic compressor rotor having a first direction of rotation is directed to a second supersonic compressor rotor configured to counter-rotate with respect to the first supersonic compressor rotor. In one embodiment, the counter-rotary supersonic compressor rotors are arrayed such that the first supersonic compressor rotor is disposed within the inner cylindrical cavity of the second supersonic compressor rotor.

Figure 8:
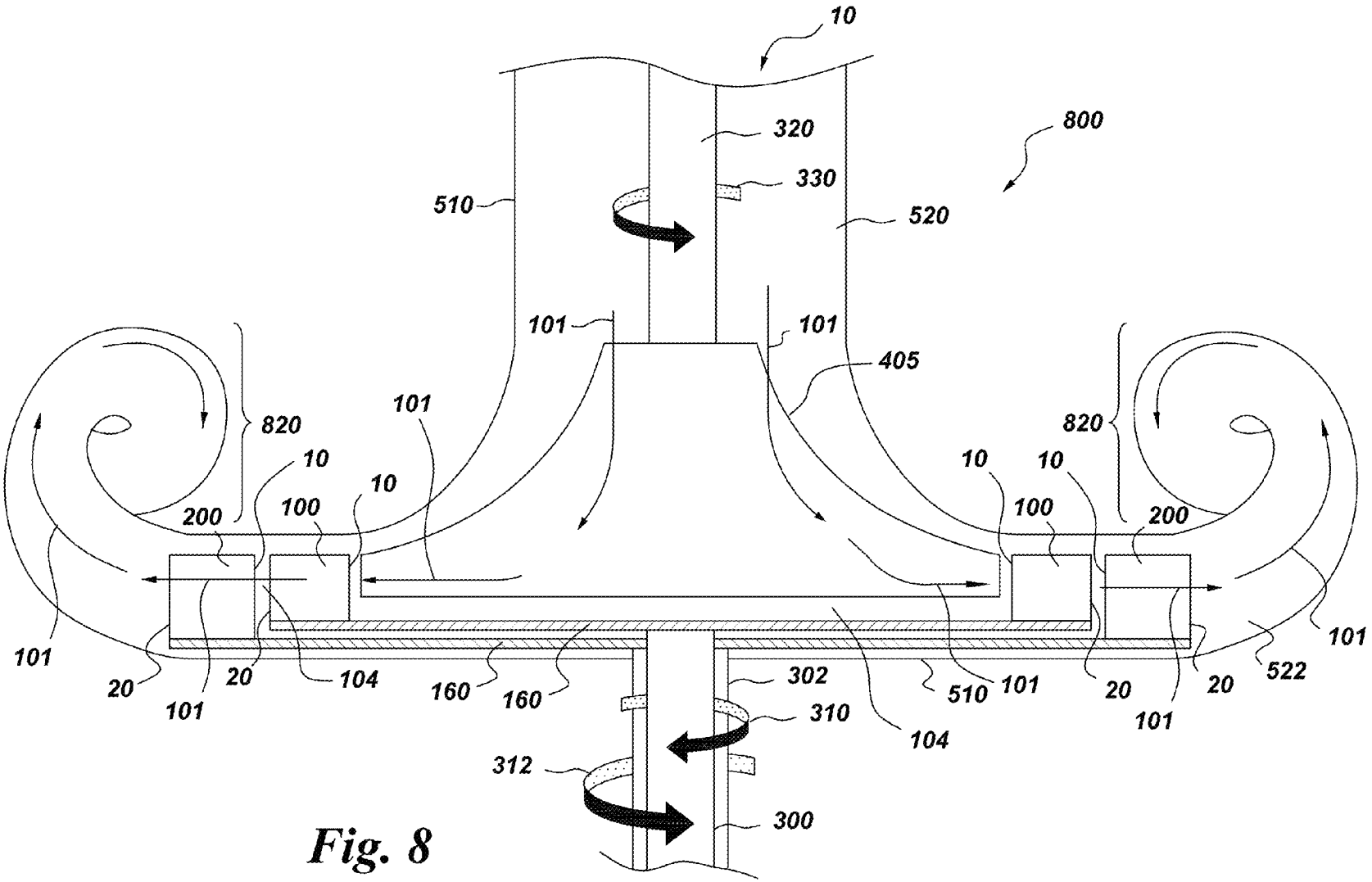
FIG. 8 represents a supersonic compressor comprising a conventional centrifugal compressor rotor and a pair of concentric supersonic compressor rotors.

Referring to FIG. 8, the figure illustrates an exemplary supersonic compressor 800 comprising a conventional centrifugal compressor rotor 405, and a pair of supersonic compressor rotors of the present invention configured concentrically. The supersonic compressor shown in FIG. 8 comprises a first supersonic compressor rotor 100, and a second supersonic compressor rotor 200. The aforementioned rotors are disposed within a fluid conduit comprising a low pressure side 520 and a high pressure side 522 contained within compressor housing 510. The conventional centrifugal compressor rotor 405 is shown as disposed within the inner cylindrical cavity 104 of the first supersonic compressor rotor 100, and the first supersonic compressor rotor 100 is shown as disposed within the inner cylindrical cavity 104 of the second supersonic compressor rotor 200. The first supersonic compressor rotor 100 is driven by drive shaft 300 in direction 310. The second supersonic compressor rotor 200 is driven by drive shaft 302 in direction 312. The supersonic compressor rotors 100 and 200 are shown as counter-rotating with respect to one another. The conventional centrifugal compressor rotor 405 is driven by drive shaft 320 in direction 330. The output of the conventional centrifugal compressor rotor 405 is directed through an inner cylindrical cavity 104 into the first supersonic compressor rotor 100. The output of the first supersonic compressor rotor 100 is directed to the inner cylindrical cavity 104 of the second supersonic compressor rotor 200. In the embodiment shown in FIG. 8, the output of the second supersonic compressor rotor 200 is directed into scroll 820.

The supersonic compressor rotors provided by the present invention may in some embodiments, such as that shown in FIG. 8, comprise a plurality of supersonic compressor rotors. Where the supersonic compressor rotors are arranged in series, it is at times advantageous to configure the supersonic compressor rotors to be counter-rotatory. In one embodiment, the present invention provides a supersonic compressor comprising at least three counter-rotary supersonic compressor rotors each comprising at least one radial flow channel. For example, the supersonic compressor rotors may be configured in series such that an output from a first supersonic compressor rotor having a first direction of rotation is directed to a second supersonic compressor rotor configured to counter-rotate with respect to the first supersonic compressor rotor, and further such that an output from the second supersonic compressor rotor is directed to a third supersonic compressor rotor configured to counter-rotate with respect to the second supersonic compressor rotor. In one embodiment, the counter-rotary supersonic compressor rotors are arrayed such that the first supersonic compressor rotor is disposed within the inner cylindrical cavity of the second supersonic compressor rotor, and the second supersonic compressor rotor is disposed within the inner cylindrical cavity of the third supersonic compressor rotor.

Those of ordinary skill in the art will understand that the performance of both conventional compressors and supersonic compressors may be enhanced by the inclusion of fluid guide vanes within the compressor. Thus, in one embodiment, the present invention provides a supersonic compressor comprising a fluid inlet, a fluid outlet, at least one supersonic compressor rotor defining an inner cylindrical cavity and an outer rotor rim and at least one radial flow channel, and one or more fluid guide vanes. In one embodiment, the supersonic compressor may comprise a plurality of fluid guide vanes. The fluid guide vanes may be disposed between the fluid inlet and the supersonic compressor rotor, or between the supersonic compressor rotor and the fluid outlet, or some combination thereof. Thus in one embodiment, the supersonic compressor provided by the present invention comprises fluid guide vanes disposed between the fluid inlet and the supersonic compressor rotor, in which instance the fluid guide vanes may be referred to logically as inlet guide vanes (IGV). In another embodiment, the supersonic compressor provided by the present invention comprises fluid guide vanes disposed between a first and second supersonic compressor rotor, in which instance the fluid guide vanes may be referred to logically as intermediate guide vanes (IntGV). In another embodiment, the supersonic compressor provided by the present invention comprises fluid guide vanes disposed between the a supersonic compressor rotor and the fluid outlet, in which instance the fluid guide vanes may be referred to logically as outlet guide vanes (OGV). In one embodiment, the supersonic compressor provided by the present invention comprises a plurality of supersonic compressor rotors and a combination of inlet guide vanes, outlet guide vanes and intermediate guide vanes.

In one embodiment, the supersonic compressor provided by the present invention is comprised within a larger system, for example a gas turbine engine, for example a jet engine. It is believed that because enhanced compression ratios may be attainable by the supersonic compressors provided by the present invention the overall size and weight of a gas turbine engine may be reduced and attendant benefits derived therefrom.

In one embodiment, the supersonic compressor provided by the present invention comprises (a) a gas conduit comprising (i) a low pressure gas inlet and (ii) a high pressure gas outlet; (b) a first supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp; (c) a second supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp; and (d) a conventional centrifugal compressor rotor, said first supersonic compressor rotor, said second supersonic compressor rotor and said conventional centrifugal compressor rotor being disposed within said gas conduit. In one embodiment, the conventional centrifugal compressor rotor is disposed within the inner cylindrical cavity of the first supersonic compressor rotor, and the first supersonic compressor rotor is disposed within the inner cylindrical cavity of the second supersonic compressor rotor, the conventional centrifugal compressor rotor being configured to counter-rotate with respect to said first supersonic compressor rotor, and the first supersonic compressor rotor being configured to counter-rotate with respect to said second supersonic compressor rotor, said conventional centrifugal compressor rotor and said first supersonic compressor rotor and said second supersonic compressor rotor being disposed within the gas conduit.

The following discussion is included in this disclosure to provide additional technical insights into the operation of supersonic compressors. For the sake of brevity, the discussion focuses on gas dynamics within a particular type of supersonic compressor provided by the present invention, a supersonic compressor comprising a supersonic compressor rotor and various inlet and outlet guide vanes. Supersonic compressors require high relative velocities of the gas entering the supersonic compressor rotor. These velocities must be greater than the local speed of sound in the gas, hence the descriptor "supersonic". For purposes of the discussion contained in this section, a supersonic compressor during operation is considered, the supersonic compressor comprising both inlet guide vanes and exit guide vanes. A gas is introduced through a gas inlet into the supersonic compressor comprising a plurality of inlet guide vanes (IGV) arrayed upstream of a first supersonic compressor rotor, a second supersonic compressor rotor, and a set of outlet guide vanes (OGV). The gas emerging from the IGV is compressed by the first supersonic compressor rotor and the output of the first supersonic compressor rotor is directed to the second (counter-rotary) supersonic compressor rotor the output of which encounters and is modified by a set of outlet guide vanes (OGV). As the gas encounters the inlet guide vanes (IGV), the gas is accelerated to a high tangential velocity by the IGV. This tangential velocity is combined with the tangential velocity of the rotor and the vector sum of these velocities determines the relative velocity of the gas entering the rotor. The acceleration of the gas through the IGV results in a reduction in the local static pressure which must be overcome by the pressure rise in the supersonic compressor rotor. The pressure rise across the rotor is a function of the inlet absolute tangential velocity and the exit absolute tangential velocity along with the radius, fluid properties, and rotational speed, and is given by Equation I wherein $P_1$ is the inlet pressure, $P_2$ is the exit pressure, $\gamma$ is a ratio of specific heats of the gas being compressed, $\Omega$ is the rotational speed, r is the radius, $V_\Theta$ is the tangential velocity, $\eta$ (see exponent) is polytropic efficiency, and $C_{01}$ is stagnation speed of sound at the inlet which is equal to the square root of $(\gamma*R*T_0)$ where R is the gas constant and $T_0$ is the total temperature if the incoming gas. Those of ordinary skill in the art will recognize Equation I as a form of Euler's equation for turbomachinery. High pressure ratios, across a single stage are achieved when the value of $\Delta(rV_\Theta)$ is large.

$$\frac{P_2}{P_1} = \left[1 + \frac{(\gamma - 1)\Omega\Delta(rv_\theta)}{c_{01}^2}\right]^{\frac{\gamma\eta}{\gamma-1}} \qquad \text{Equation I}$$

Supersonic compressor rotors such as those provided by the present invention may be manufactured using any of the materials currently used for conventional compressors including aluminum alloys, steel alloys, nickel alloys, and titanium alloys, depending on the required strength and temperature capability. Composite structures may also be used which combine the relative strengths of several different materials including those listed above and non-metallic materials. Compressor casings, inlet guide vanes, exit guide vanes, and exhaust scrolls may be made of any material used for current turbomachinery devices including cast iron.

As noted, in one embodiment, the present invention provides a method of compressing a fluid comprising (a) introducing a fluid through a low pressure gas inlet into a gas conduit comprised within a supersonic compressor; and (b) removing a gas through a high pressure gas outlet of said supersonic compressor; said supersonic compressor comprising a supersonic compressor rotor disposed between said gas inlet and said gas outlet, said supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp. The method provided by the present invention may be used to prepare a compressed fluid such as a compressed gas. In one embodiment, the method provided by the present invention may be used to prepare a compressed natural gas in the form of liquefied natural gases. Other gases which may be compressed using the method of the present invention include air, carbon dioxide, nitrogen, argon, helium, hydrogen, oxygen, carbon monoxide, sulfur hexafluoride, refrigerant gases, and mixtures thereof. Refrigerant gases include dichlorotrifluoroethane (at times referred to as R123), 1,1,1,2,3,3,3-heptafluoropropane, hexafluoroethane, chlorodifluoromethane, and the like.

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. A supersonic compressor comprising:

(a) a fluid inlet;

(b) a fluid outlet; and (c) a plurality of supersonic compressor rotors, said supersonic compressor rotors defining an inner cylindrical cavity and an outer rotor rim and at least one radial flow channel allowing fluid communication between the inner cylindrical cavity and the outer rotor rim, said radial flow channel comprising a supersonic compression ramp, wherein a first supersonic compressor rotor is disposed within an inner cylindrical cavity of a second supersonic compressor rotor.

2. The supersonic compressor according to claim 1, wherein said supersonic compressor rotors comprise a plurality of vanes disposed between a pair of rotor support plates, at least one of said vanes comprising a supersonic compression ramp.

3. The supersonic compressor according to claim 1 further comprising a centrifugal compressor rotor.

4. The supersonic compressor according to claim 1, wherein the supersonic compressor rotor is configured for inside-out compression.

5. The supersonic compressor according to claim 1, wherein said supersonic compressor rotors comprise a plurality of radial flow channels.

6. The supersonic compressor according to claim 1, further comprising a plurality of vanes defining a plurality of radial flow channels.

7. The supersonic compressor according to claim 1, which is comprised within a gas turbine engine.

8. The supersonic compressor according to claim 1, wherein the first and second supersonic compressor rotors are configured for counter rotary motion.

9. The supersonic compressor according to claim 1, wherein said supersonic compression ramp is integral to a vane.

10. The supersonic compressor according to claim 1, wherein said supersonic compression ramp is not integral to a vane.

11. The supersonic compressor according to claim 1, wherein at least one of the supersonic compressor rotors defines a plurality of radial flow channels.

12. The supersonic compressor according to claim 1, wherein the supersonic compressor rotors are configured for inside-out compression.

13. The supersonic compressor according to claim 12, further comprising a centrifugal compressor disposed within an inner cylindrical cavity of the first supersonic compressor rotor.

14. The supersonic compressor rotor according to claim 1, wherein the radial flow channel defines a subsonic diffusion zone.

15. The supersonic compressor rotor according to claim 1, wherein a plurality of vanes disposed between a pair of rotor support plates define a plurality of radial flow channels, at least one of said vanes comprising said supersonic compression ramp.

16. A supersonic compressor comprising:

(a) a gas conduit comprising (i) a low pressure gas inlet, and (ii) a high pressure gas outlet;

(b) a first supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp;

(c) a second supersonic compressor rotor defining an inner cylindrical cavity and an outer rotor rim and at least one radial flow channel allowing fluid communication between the inner cylindrical cavity and the outer rotor rim, said radial flow channel comprising a supersonic compression ramp; and (d) a centrifugal compressor rotor;

said centrifugal compressor rotor being disposed within the inner cylindrical cavity of the first supersonic compressor rotor, said first supersonic compressor rotor being disposed within the inner cylindrical cavity of the second supersonic compressor rotor, said centrifugal compressor rotor being configured to counter-rotate with respect to said first supersonic compressor rotor, said first supersonic compressor rotor being configured to counter-rotate with respect to said second supersonic compressor rotor, said centrifugal compressor rotor and said first supersonic compressor rotor and said second supersonic compressor rotor being disposed within the gas conduit.

17. A method of compressing a fluid, said method comprising:

(a) introducing a fluid through a low pressure gas inlet into a gas conduit comprised within a supersonic compressor; and (b) removing a gas through a high pressure gas outlet of said supersonic compressor;

said supersonic compressor comprising a plurality of supersonic compressor rotors, said supersonic compressor rotors defining an inner cylindrical cavity and an outer rotor rim and at least one radial flow channel allowing fluid communication between the inner cylindrical cavity and the outer rotor rim, said radial flow channel comprising a supersonic compression ramp, wherein a first supersonic compressor rotor is disposed within an inner cylindrical cavity of a second supersonic compressor rotor.

18. The method according to claim 17, wherein said fluid comprises carbon dioxide.

* * * * *